US010257900B2

(12) United States Patent
Hagelaar et al.

(10) Patent No.: US 10,257,900 B2
(45) Date of Patent: Apr. 9, 2019

(54) DETERMINING PROPERTY OF UNCHANGED LOAD DEVICE

(71) Applicant: SIGNIFY HOLDING B.V., Eindhoven (NL)

(72) Inventors: Joris Hubertus Antonius Hagelaar, Eindhoven (NL); Marcel Van Der Ham, Eindhoven (NL); Aart Jan Vroegop, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/758,266

(22) PCT Filed: Aug. 16, 2016

(86) PCT No.: PCT/EP2016/069422

§ 371 (c)(1),
(2) Date: Mar. 7, 2018

(87) PCT Pub. No.: WO2017/041999

PCT Pub. Date: Mar. 16, 2017

(65) Prior Publication Data

US 2018/0249544 A1 Aug. 30, 2018

(30) Foreign Application Priority Data

Sep. 8, 2015 (EP) ..... 15184256

(51) Int. Cl.
*H05B 33/08* (2006.01)

(52) U.S. Cl.
CPC ..... *H05B 33/0851* (2013.01); *H05B 33/0815* (2013.01); *H05B 33/0827* (2013.01); *H05B 33/0866* (2013.01); *H05B 33/0893* (2013.01)

(58) Field of Classification Search
None
See application file for complete search history.

(56) References Cited

U.S. PATENT DOCUMENTS 6,130,530 A 10/2000 McNulty
6,864,867 B2 * 3/2005 Biebl ..... H05B 33/0815 345/82

(Continued)

FOREIGN PATENT DOCUMENTS

EP 2160928 A2 3/2010
GB 2434929 A 8/2007

(Continued)

*Primary Examiner* — Vibol Tan

(57) ABSTRACT

Determination devices (1) determine properties of load devices (2) that may remain unchanged for said determining and that comprise first channels with first elements (20, 25). The determination devices comprise first switches (10) for providing first invitation signals to the first channels, detectors (15, 16) for detecting first response signals that result from the first invitation signals, and controllers (17) for deriving the properties of the load devices (2) from detections of the first response signals. The properties define first maximum values of first loads of the first channels, and the controllers (17) calculate first maximum duty cycles of first supply signals for supplying the first channels in view of the first maximum values of the first loads and power capacities of power supplies (3) that produce the first supply signals. The load devices (2) may further comprise second channels with second elements (21, 26), and the determination devices (1) may further comprise second switches (11).

12 Claims, 5 Drawing Sheets

(56) References Cited

U.S. PATENT DOCUMENTS

| | | | | |
|---|---|---|---|---|
| 7,233,112 | B2 * | 6/2007 | Burke | H02M 5/293 315/209 R |
| 8,581,521 | B2 * | 11/2013 | Welten | H05B 33/083 315/113 |
| 9,491,845 | B2 * | 11/2016 | Melanson | H05B 33/0854 |
| 2011/0043125 | A1 | 2/2011 | Peeters | |
| 2013/0278149 | A1 | 10/2013 | Van Kaathoven et al. | |
| 2014/0300278 | A1 | 10/2014 | Van Bodegraven | |
| 2015/0173142 | A1 | 6/2015 | Van Der Veen et al. | |
| 2018/0112861 | A1 * | 4/2018 | Hagelaar | H05B 33/0803 |

FOREIGN PATENT DOCUMENTS

| | | | |
|---|---|---|---|
| WO | 2012072629 | A2 | 6/2012 |
| WO | 2015010972 | A2 | 1/2015 |

* cited by examiner

DETERMINING PROPERTY OF UNCHANGED LOAD DEVICE

CROSS-REFERENCE TO PRIOR APPLICATION

This application is the U.S. National Phase application under 35 U.S.C. § 371 of International Application No. PCT/EP2016/069422, filed on Aug. 16, 2016 which claims the benefit of European Patent Application No. 15184256.4 filed on Sep. 8, 2015. These applications are hereby incorporated by reference herein.

FIELD OF THE INVENTION

The invention relates to a determination device for determining a property of a load device. The invention further relates to a feeding device for feeding a load device, which feeding device comprises such a determination device, to a system comprising such a feeding device, to a method for determining a property of a load device, to a computer program product, and to a medium. Examples of such a load device are light-emitting-diode-strips with one or more parallel channels.

BACKGROUND OF THE INVENTION

WO 2015/010972 A2 discloses power supply for a light-emitting-diode lighting system, wherein the load device has been extended with additional components in the form of impedance modules to allow the load device to be investigated.

U.S. 2015/0173142 A1 discloses a self-adjusting lighting driver for driving lighting sources, wherein the load device has been extended with additional components in the form of current sources and with additional connections to these current sources to allow the load device to be investigated.

SUMMARY OF THE INVENTION

It is an object of the invention to provide an improved determination device. It is a further object of the invention to provide a feeding device for feeding a light emitting diode strip, which feeding device comprises such an improved determination device, to provide a system comprising such a feeding device, to provide an improved method for determining a maximum power dissipation property of a light emitting diode strip, to provide a computer program product, and to provide a medium.

According to a first aspect, a determination device is provided for determining a maximum power dissipation property of a light emitting diode strip, which light emitting diode strip may preferably remain unchanged for said determining, and which light emitting diode strip comprises a first channel with one or more first elements, which determination device comprises:

- a first switch configured to provide a first voltage pulse to the first channel,
- a detector configured to detect a first current signal that results from a provision of the first voltage pulse to the first channel, and
- a controller configured to derive the maximum power dissipation property of the light emitting diode strip from a detection of the first current signal.

A determination device is configured to determine a maximum power dissipation property of a light emitting diode strip. Different light emitting diode strips may show different properties such as different amounts of power dissipation, different numbers of channels, different amounts of power dissipation per channel, and different types of loads. Even one and the same light emitting diode strip may show a varying maximum power dissipation property depending on where it has been cut. To a feeding device for feeding a light emitting diode strip, it is important to be informed about the maximum power dissipation property of the light emitting diode strip.

The light emitting diode strip preferably remains unchanged for said determining. The light emitting diode strip comprises a first channel that comprises one or more first elements. In case the first channel consists of two elements, these elements may be coupled to each other in whatever serial or parallel combination. In case the first channel consists of three or more elements, these elements may be coupled to each other in whatever serial and/or parallel combination. The first channel may be the only channel in the light emitting diode strip. Alternatively, the first channel may be one out of several channels in the light emitting diode strip. The determination device comprises a first switch for providing a first voltage pulse to the first channel. The determination device further comprises a detector for detecting a first current signal that results from a provision of the first voltage pulse to the first channel. The determination device further comprises a controller for deriving the maximum power dissipation property of the light emitting diode strip from a detection of the first current signal as performed by the detector.

By allowing the light emitting diode strip to remain unchanged for said determining, it is no longer necessary to extend the light emitting diode strip with additional components and with additional connections, as is done in said prior art. This is a great technical advantage.

The first elements in the first channel may be any kind of elements, such as for example light-emitting-diodes or resistors etc. The first switch may be any kind of switch, such as for example a semi-conductor switch or a mechanical switch etc. The detector may be any kind of suitable detector, such as for example a current detector etc. The controller may be any kind of suitable controller, such as for example a micro controller or a processor etc.

The maximum power dissipation property defines a first maximum value of a first load of the first channel, and the controller is configured to calculate a first maximum duty cycle of a first power supply signal for supplying the first channel in view of the first maximum value of the first load and a power capacity of a power supply that produces the first power supply signal. The property to be determined may be a first maximum value of a first load (read: first power dissipation) of the first channel. The first maximum value of the first load of the first channel may be expressed in the unit Watt, or may be expressed in the unit of the response signal. In case the first invitation signal comprises a voltage signal, such as for example a voltage pulse, the first response signal comprises a current signal, and the unit of the first response signal is Ampere. The first maximum value of the first load of the first channel will be proportional to a maximum value of the first current signal. The controller is configured to calculate a first maximum duty cycle of a first power supply signal for supplying the first channel.

For a given first maximum value of the first load of the first channel and for a given power capacity of a power supply that produces the first power supply signal, which power capacity is available for the first channel, a product of the first maximum value of the first load of the first channel and the first maximum duty cycle should be equal to or smaller than the power capacity.

An embodiment of the determination device is defined, wherein the controller is configured to control the first switch, and wherein the first switch is configured to switch the first voltage pulse as well as the first power supply signal. Preferably, one and the same first switch is used for switching both the first voltage pulse and the first power supply signal. In that case, one and the same power supply can be used for providing the first voltage pulse and the first power supply signal to the first channel, via one and the same first switch. The first voltage pulse is provided for getting a fingerprint of the light emitting diode strip, and the first power supply signal is provided for supplying the light emitting diode strip.

An embodiment of the determination device is defined, wherein the light emitting diode strip further comprises multiple channels each with one or more further elements, wherein the determination device further comprises a switch for each of the multiple channels, each switch configured to provide a voltage pulse to the channel associated with the switch, wherein the detector is configured to detect each of the current signals that result from a provision of the voltage pulse to each of the multiple channels, and wherein the controller is configured to derive the maximum power dissipation property of the light emitting diode strip from a combination of the detection of each of the current signals.

Usually, the light emitting diode strip comprises several channels, such as for example a first channel with first elements and a second channel with second elements. The determination device comprises a second switch for providing a second voltage pulse to the second channel. The detector detects a second current signal that results from a provision of the second voltage pulse to the second channel. The controller derives the maximum power dissipation property of the light emitting diode strip from a combination of the detection of the first current signal and a detection of the second current signal.

An embodiment of the determination device is defined, wherein the light emitting diode strip further comprises a second channel with one or more second elements, wherein the determination device further comprises:

a second switch configured to provide a second voltage pulse to the second channel, wherein the detector is configured to detect a second current signal that results from a provision of the second voltage pulse to the second channel, and wherein the controller is configured to derive the maximum power dissipation property of the light emitting diode strip from a combination of the detection of the first current signal and a detection of the second current signal. Three or more channels in the light emitting diode strip are not to be excluded.

Independently of the number of channels in the light emitting diode strip, the determination device can derive the maximum power dissipation property of the light emitting diode strip automatically without the need for outside action and this derivation can be used for setting specific parameters in software, for example to perform an automatic configuration which might reduce a manufacturing complexity considerably.

An embodiment of the determination device is defined, wherein the maximum power dissipation property defines a first maximum value of a first load of the first channel and a second maximum value of a second load of the second channel, and wherein the controller is configured to calculate a first maximum duty cycle of a first power supply signal for supplying the first channel and to calculate a second maximum duty cycle of a second power supply signal for supplying the second channel in view of the first maximum value of the first load and the second maximum value of the second load and a power capacity of a power supply that produces the first and second power supply signals. The maximum power dissipation property to be determined may be a first maximum value of a first load (read: first power dissipation) of the first channel and a second maximum value of a second load (read: second power dissipation) of the second channel. The first (second) maximum value of the first (second) load of the first (second) channel may be expressed in the unit Watt, or may be expressed in the unit of the response signal. In case the first (second) invitation signal comprises a voltage signal, such as for example a voltage pulse, the first (second) response signal comprises a current signal, and the unit of the first (second) response signal is Ampere. The first (second) maximum value of the first (second) load of the first (second) channel will be proportional to a maximum value of the first (second) current signal. The controller is configured to calculate a first maximum duty cycle of a first power supply signal for supplying the first channel and is configured to calculate a second maximum duty cycle of a second power supply signal for supplying the second channel.

For a given first maximum value of the first load of the first channel and for a given second maximum value of the second load of the second channel and for a given power capacity of a power supply that produces the first and second power supply signals, which power capacity is available for the first and second channels, a sum of a first product of the first maximum value of the first load of the first channel and the first maximum duty cycle and a second product of the second maximum value of the second load of the second channel and the second maximum duty cycle should be equal to or smaller than the power capacity.

In case the light emitting diode strip comprises several channels, a first channel may comprise one or more elements that are different from one or more elements of a second channel. By comparing the first maximum value of the first load (the first maximum value of the first power dissipation or the first maximum value of the first current signal) and the second maximum value of the second load (the second maximum value of the second power dissipation or the second maximum value of the second current signal), the different types of loads can be distinguished from each other. And by providing a maximum number of voltage pulses to a possible maximum number of channels and by counting the number of current signals, the real number of present channels can be determined.

A light emitting diode strip may for example comprise one to five channels. The situations with one and two channels have been discussed above. The situation with three channels is as follows: For a given first to third maximum value of the first to third load of the first to third channel and for a given power capacity of a power supply that produces the first to third power supply signals, which power capacity is available for the first to third channels, a sum of a first product of the first maximum value of the first load of the first channel and the first maximum duty cycle and a second product of the second maximum value of the second load of the second channel and the second maximum duty cycle and a third product of the third maximum value of the third load of the third channel and the third maximum duty cycle should be equal to or smaller than the power capacity etc.

More generally, the light emitting diode strip can be any kind of light emitting diode strip, that may comprise up to N channels, with N being an integer >1. Theoretically, N can be 100 or 1000 or even larger.

An embodiment of the determination device is defined, wherein the controller is configured to control the first and second switches, wherein the first switch is configured to switch the first voltage pulse as well as the first power supply signal, and wherein the second switch is configured to switch the second voltage pulse as well as the second power supply signal. Preferably, one and the same first switch is used for switching both the first voltage pulse and the first power supply signal, and one and the same second switch is used for switching both the second voltage pulse and the second power supply signal. In that case, one and the same power supply can be used for providing the first voltage pulse and the first power supply signal to the first channel, via one and the same first switch, and for providing the second voltage pulse and the second power supply signal to the second channel, via one and the same second switch. The first and second voltage pulses are provided for getting a fingerprint of the light emitting diode strip, and the first and second power supply signals are provided for supplying the light emitting diode strip.

An embodiment of the determination device is defined, wherein the first and second switches are configured to provide the first and second voltage pulses after another, and wherein the detector is configured to detect the first and second current signals after another. Preferably, according to a simple embodiment, the detector can only detect one current signal at a time. By providing the first and second voltage pulses after another, the first and second current signals will come back after another, and the detector can detect the first and second current signals after another.

An embodiment of the determination device is defined, wherein the maximum power dissipation property defines at least one of a group consisting of a total load of the light emitting diode strip and a first load of the first channel and a second load of the second channel and a number of channels and a first type of load in the first channel and a second type of load in the second channel. Again, each maximum value of each load of each channel may be expressed in the unit Watt, or may be expressed in the unit of the current signal.

An embodiment of the determination device is defined, wherein the first voltage pulse comprises a first voltage signal and the second voltage pulse comprises a second voltage signal and wherein the first current signal comprises a first current signal and the second current signal comprises a second current signal. Preferably, the first voltage pulse comprises a first voltage signal such as a first voltage pulse having a first duration and a first amplitude and the second voltage pulse comprises a second voltage signal such as a second voltage pulse having a second duration and a second amplitude. The first current signal then comprises a first current signal and the second current signal then comprises a second current signal, that can be detected by a voltage detector for detecting a first (second) voltage difference present across a resistor in response to the first (second) current signal flowing through the resistor etc. Preferably, the first and second durations will be equal durations, and the first and second amplitudes will be equal amplitudes.

An embodiment of the determination device is defined, wherein an unchanged light emitting diode strip comprises a light emitting diode strip that has not been extended with an additional component or with an additional connection.

According to a second aspect, a feeding device is provided for feeding a light emitting diode strip, wherein the feeding device comprises both a power supply (3) and the determination device as defined above.

According to a third aspect, a system is provided comprising the feeding device as defined above, wherein the system further comprises the light emitting diode strip.

According to a fourth aspect, a method is provided for determining a maximum power dissipation property of a light emitting diode strip comprising a first channel with one or more first elements, the method comprising the steps of:

providing, for example by a first switch, a first voltage pulse to the first channel, detecting, for example by a detector, a first current signal that results from a provision of the first voltage pulse to the first channel, and deriving, for example by a controller, the maximum power dissipation property of the light emitting diode strip from a detection of the first current signal.

According to a fifth aspect, a computer program product is provided for performing the steps of the method as defined above when run via a computer.

According to a sixth aspect, a medium is provided for storing and comprising the computer program product as defined above.

A basic idea is that, to determine a maximum power dissipation property of a light emitting diode strip, a first voltage pulse is to be provided, a first current signal is to be detected, and the maximum power dissipation property of the light emitting diode strip is to be derived from a detection of the first current signal.

A problem to provide an improved determination device has been solved. A further advantage is that the determination device can be simple, low cost and robust and that it can be easily integrated into a feeding device.

These and other aspects of the invention will be apparent from and elucidated with reference to the embodiments described hereinafter.

DETAILED DESCRIPTION OF EMBODIMENTS

Figure 1:
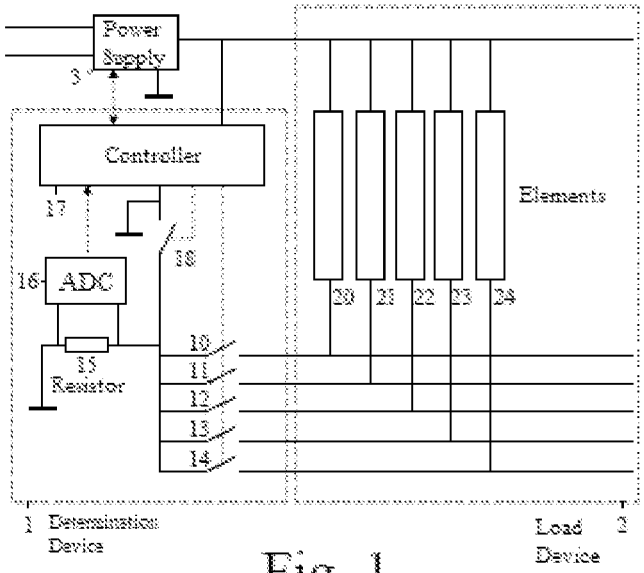
FIG. 1 shows an embodiment of a determination device.

In the FIG. 1, an embodiment of a determination device is shown. The determination device 1 comprises a first switch 10 having a first contact coupled to a first side of a resistor 15 of a detector 15, 16 and having a second contact coupled to a first side of a first channel of a load device 2, which first channel here comprises one or more first elements 20. The determination device 1 comprises a second switch 11 having a first contact coupled to said first side of the resistor 15 of the detector 15, 16 and having a second contact coupled to a first side of a second channel of the load device 2, which second channel here comprises one or more second elements 21. The determination device 1 comprises a third switch 12 having a first contact coupled to said first side of the resistor 15 of the detector 15, 16 and having a second contact coupled to a first side of a third channel of the load device 2, which third channel here comprises one or more third elements 22. The determination device 1 comprises a fourth switch 13 having a first contact coupled to said first side of the resistor 15 of the detector 15, 16 and having a second contact coupled to a first side of a fourth channel of the load device 2, which fourth channel here comprises one or more fourth elements 23. The determination device 1 comprises a fifth switch 14 having a first contact coupled to said first side of the resistor 15 of the detector 15, 16 and having a second contact coupled to a first side of a fifth channel of the load device 2, which fifth channel here comprises one or more fifth elements 24.

Second sides of the first, second, third, fourth and fifth channels are coupled to an output of the power supply 3 that for example provides an output voltage signal having a constant amplitude (for example 12 Volt) to the load device 2. Inputs of the power supply 3 are for example coupled to the mains. A second side of the resistor 15 is coupled to ground, and the first and second sides of the resistor 15 are coupled to inputs of an analog-to-digital-converter 16. An output of the analog-to-digital-converter 16 is coupled to an input of a controller 17 for information purposes. The first side of the resistor 15 is further coupled via a switch 18 to ground such that the resistor 15 can be short-circuited via the switch 18. The controller 17 is coupled to the switches 10-14 and 18 for controlling purposes and is coupled to the power supply 3 for information and/or controlling purposes. Via the output of the power supply 3, the controller 17 may be fed.

Figure 2:
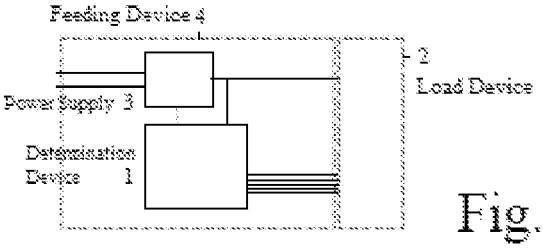
FIG. 2 shows an embodiment of a feeding device.

In the FIG. 2, an embodiment of a feeding device is shown. The feeding device 4 comprises the determination device 1 and the power supply 3 and is coupled to the load device 2, all shown in and discussed at the hand of the FIG. 1.

Figure 3:
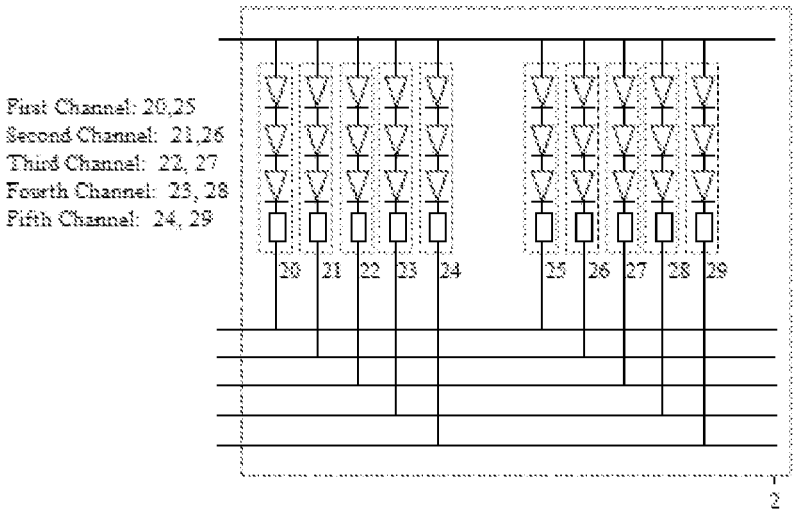
FIG. 3 shows an embodiment of a load device.

In the FIG. 3, an embodiment of a load device is shown. The load device 2 comprises a first channel with a parallel combination of elements 20 and 25. The elements 20 comprise a serial combination of three light-emitting-diodes and a resistor, and the elements 25 comprise a serial combination of three light-emitting-diodes and a resistor. The load device 2 comprises a second channel with a parallel combination of elements 21 and 26. The elements 21 comprise a serial combination of three light-emitting-diodes and a resistor, and the elements 26 comprise a serial combination of three light-emitting-diodes and a resistor. The load device 2 comprises a third channel with a parallel combination of elements 22 and 27. The elements 22 comprise a serial combination of three light-emitting-diodes and a resistor, and the elements 27 comprise a serial combination of three light-emitting-diodes and a resistor. The load device 2 comprises a fourth channel with a parallel combination of elements 23 and 28. The elements 23 comprise a serial combination of three light-emitting-diodes and a resistor, and the elements 28 comprise a serial combination of three light-emitting-diodes and a resistor. The load device 2 comprises a fifth channel with a parallel combination of elements 24 and 29. The elements 24 comprise a serial combination of three light-emitting-diodes and a resistor, and the elements 29 comprise a serial combination of three light-emitting-diodes and a resistor. As an example only, the first channel may produce red light, the second channel may produce green light, the third channel may produce blue light, and the fourth and fifth channels may produce the same or different kinds of white light.

Figure 4:
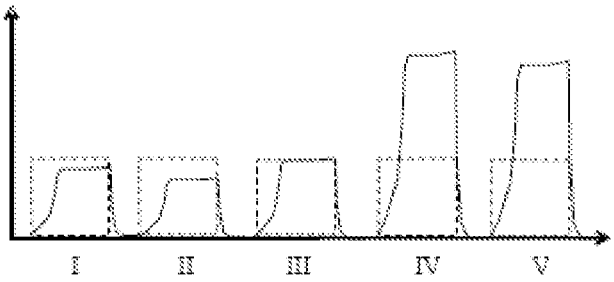
FIG. 4 shows invitation signals and response signals.

In the FIG. 4, invitation signals and response signals are shown, for the first channel I, the second channel II, the third channel III, the fourth channel IV and the fifth channel V (horizontal axis time, vertical axis amplitude). The determination device 1 functions as follows, in view of the FIG. 1-4:

The determination device 1 determines a property of the load device 2, such as for example a total load of the load device 2, a load per channel, a number of channels and a type of load per channel, without having excluded other kinds of properties, and without the load device 2 needing to be changed for said determining. During determination, the switch 18 is in a non-conducting state, and the resistor 15 is not short-circuited.

Firstly, the controller 17 brings the first switch 10 into a conducting state for a short moment in time, such as for example 1 μs or 10 μs or 100 μs, without having excluded other values. As a result, a loop is closed from the output of the power supply 3 via the first channel I (elements 20, 25) of the load device 2 and via the first switch 10 and via the resistor 15 to ground, and a first invitation signal here in the form of the output voltage signal of the power supply 3 is provided to the first channel I. In the FIG. 4, this first invitation signal is indicated by the dashed voltage pulse for the first channel I. As a result, a first response signal here in the form of a current signal that results from a provision of the first invitation signal to the first channel I flows from the output of the power supply 3 via the first channel I and via the first switch 10 and via the resistor 15 to ground. In the FIG. 4, this first response signal is indicated by the straight current signal for the first channel I. Via the detector 15, 16, this first response signal is detected, and the controller 17 is informed of the detection of the first response signal.

Secondly, the controller 17 brings the second switch 11 into a conducting state for a short moment in time, such as for example 1 μs or 10 μs or 100 μs, without having excluded other values. As a result, a loop is closed from the output of the power supply 3 via the second channel II (elements 21, 26) of the load device 2 and via the second switch 11 and via the resistor 15 to ground, and a second invitation signal here in the form of the output voltage signal of the power supply 3 is provided to the second channel II. In the FIG. 4, this second invitation signal is indicated by the dashed voltage pulse for the second channel II. As a result, a second response signal here in the form of a current signal that results from a provision of the second invitation signal to the second channel II flows from the output of the power supply 3 via the second channel II and via the second switch 11 and via the resistor 15 to ground. In the FIG. 4, this second response signal is indicated by the straight current signal for the second channel II. Via the detector 15, 16, this second response signal is detected, and the controller 17 is informed of the detection of the second response signal.

Similarly, a third, fourth and fifth invitation signal are provided to the third, fourth and fifth channel, that result in detections of a third, fourth and fifth response signal, as all shown in the FIG. 4 for the third, fourth and fifth channel III, IV and V.

The controller 17 is configured to derive a property of the load device 2 from the detections of the first to fifth response signals. This property may for example comprise a type of load per channel. In view of the FIG. 4, by comparing the maximum values of the current signals of the first to fifth channels I to V with each other and/or with reference values, the controller 17 can determine that the elements 20, 25 in the first channel I produce red light, that the elements 21, 26 in the second channel II produce green light, that the elements 22, 27 in the third channel III produce blue light, that the elements 23, 28 in the fourth channel IV produce first white light, and that the elements 24, 29 in the fifth channel V produce second white light. This all under the assumption that only one type of load is used per channel and that the first to fifth invitation signals have relatively identical amplitudes.

As shown in the FIG. 3, the load device 2 comprises parallel combinations of elements per channel. In that case, it is most interesting to use invitation signals in the form of voltage signals and to use response signals in the form of current signals. But in other cases, where the load device 2 comprises serial combinations of elements per channel, it might be most interesting to use invitation signals in the form of current signals and to use response signals in the form of voltage signals.

In a minimum situation, the load device 2 may comprise one channel. In that case, the controller 17 may derive a property in the form of a total load of the load device 2, a first load of the first channel, a number of channels (here: only one channel will respond) and a type of load in the first channel (by comparing the maximum value of the current signal of the channel with a reference value). In a more extended situation, two or more channels may be present.

For a load device 2 in the form of a light-emitting-diode-strip, the controller 17 might even derive a property in the form of a length of the strip, under the assumption that the controller 17 knows how many parallel combinations of elements are present per unit of length of the strip for a certain channel.

The detector 15, 16 here comprises a resistor 15 for converting a value of the response signal in the form of a current signal into a voltage difference present across the resistor 15, and comprises an analog-to-digital-converter 16 for converting this voltage difference into digital values destined for the controller 17. Another way of detecting the current signal could be to use a current meter or a power meter. The detector 15, 16 is an example only and other detectors are not to be excluded.

Figure 5:
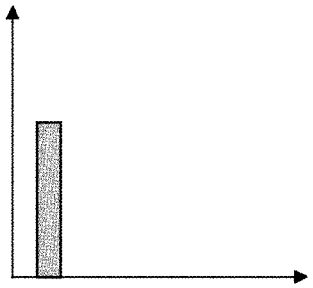
FIG. 5 shows a first fingerprint.

In the FIG. 5, a first fingerprint is shown (horizontal axis: channel, vertical axis: amplitude). This first fingerprint is based on only one current signal (another current signal than the ones shown in the FIG. 4) that has been converted into a pulse by the controller 17. From this fingerprint it is clear that this load device comprises only one channel. By comparing an amplitude of this fingerprint with a reference value (the amplitude of this fingerprint will be identical to or proportional to an amplitude of the current signal), a type of load might be derived.

Figure 6:
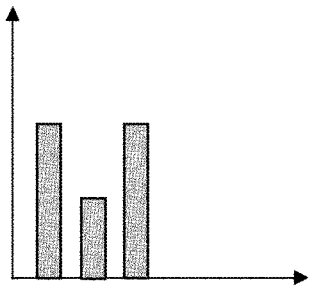
FIG. 6 shows second fingerprints.

In the FIG. 6, second fingerprints are shown (horizontal axis: channels, vertical axis: amplitude). These second fingerprints are based on three current signals (other current signals than the ones shown in the FIG. 4) that have been converted into pulses by the controller 17. From these fingerprints it is clear that this load device comprises three channels. By comparing the amplitudes of these fingerprints with each other and/or with one or more reference values (the amplitudes of these fingerprints will be identical to or proportional to the amplitudes of the current signals), a type of load per channel might be derived.

Figure 7:
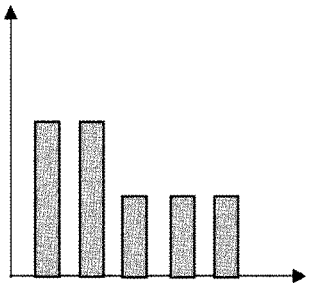
FIG. 7 shows third fingerprints.

In the FIG. 7, third fingerprints are shown (horizontal axis: channels, vertical axis: amplitude). These third fingerprints are based on five current signals (other current signals than the ones shown in the FIG. 4) that have been converted into pulses by the controller 17. From these fingerprints it is clear that this load device comprises five channels. By comparing the amplitudes of these fingerprints with each other and/or with one or more reference values, a type of load per channel might be derived.

Figure 8:
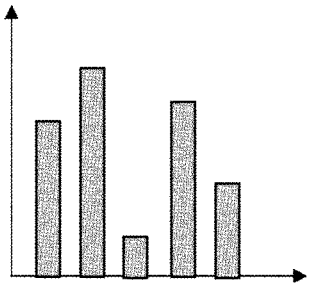
FIG. 8 shows fourth fingerprints.

In the FIG. 8, fourth fingerprints are shown (horizontal axis: channels, vertical axis: amplitude). These fourth fingerprints are based on five current signals (other current signals than the ones shown in the FIG. 4) that have been converted into pulses by the controller 17. From these fingerprints it is clear that this load device comprises five channels. By comparing the amplitudes of these fingerprints with each other and/or with one or more reference values, a type of load per channel might be derived.

This way, in case of a load device in the form of a light-emitting-diode-combination, the light-emitting-diode-types per channel can be recognized automatically without the need for outside action and this recognition can be used for setting specific parameters in software related to the detected combination. An example is a color point and a flux setting for a channel, this might be needed for a color model in the software to optimize a color consistency, whereby the color model may have requested color points as inputs and may yield optimal duty cycles as outputs. Another example is to find out the capabilities of a light-emitting-diode-engine (white light only, tunable white light or color light etc.) so that this can be used by other smart apparatuses in e.g. a smart phone or other apparatuses in a smart home.

To supply the first to fifth channels of the load device 2, the controller 17 brings the switch 18 into a conducting state, to reduce the power dissipation in the resistor 15. As a result, the resistor 15 is short-circuited, and the switches 10-14 can be used for switching first to fifth supply signals (first to fifth current signals flowing through the first to fifth channels) at certain duty cycles, for example some time after the property of the load device 2 has been determined. Alternatively, by giving the resistor 15 a sufficiently small value, the power dissipation in the resistor 15 can stay sufficiently low, without the switch 18 being needed. An advantage of keeping the resistor 15 in the current path is that a total return current (of all the channels) can be monitored and that the duty cycles can be adjusted in case of a setting drifting away.

In case the load device 2 comprises only the first channel, and the determined property defines a first maximum value of a first load (read: first power dissipation) of the first channel, the controller 17 is configured to calculate a first maximum duty cycle of a first supply signal for supplying the first channel in view of the first maximum value of the first load and a power capacity of the power supply 3 that produces the first supply signal, which power capacity is available for the first channel. The first maximum value of the first load (read: first power dissipation) of the first channel may be expressed in the unit Watt, or may be expressed in the unit of the response signal. In case the first invitation signal comprises a voltage signal, such as for example a voltage pulse, the first response signal comprises a current signal, and the unit of the first response signal is Ampere. In case the first invitation signal comprises a current signal, such as for example a current pulse, the first response signal comprises a voltage signal, and the unit of the first response signal is Volt. In both cases, the first maximum value of the first load (read: first power dissipation) of the first channel will be proportional to a maximum value of the first response signal. For a given first maximum value of the first load of the first channel and for a given power capacity of the power supply that produces the first supply signal, which power capacity is available for the first channel, a product of the first maximum value of the first load of the first channel and the first maximum duty cycle should be equal to or smaller than the power capacity.

As an example only, in case the first load of the first channel is 200 Watt, and the power supply 3 can only produce 100 Watt, then a first maximum duty cycle should be 50% or lower. As an example only, in case the first load of the first channel is 200 Watt, and the power supply 3 can only produce 50 Watt, then a first maximum duty cycle should be 25% or lower etc.

In case the load device 2 comprises the first and second channels, and the determined property defines a first maximum value of a first load (read: first power dissipation) of the first channel and a second maximum value of a second load (read: second power dissipation) of the second channel, the controller is configured to calculate a first maximum duty cycle of a first supply signal for supplying the first channel and to calculate a second maximum duty cycle of a second supply signal for supplying the second channel in view of the first maximum value of the first load and the second maximum value of the second load and a power capacity of a power supply that produces the first and second supply signals, which power capacity is available for the first and second channels. The first (second) maximum value of the first (second) load (read: first (second) power dissipation) of the first (second) channel may be expressed in the unit Watt, or may be expressed in the unit of the response signal. In case the first (second) invitation signal comprises a voltage signal, such as for example a voltage pulse, the first (second) response signal comprises a current signal, and the unit of the first (second) response signal is Ampere. In case the first (second) invitation signal comprises a current signal, such as for example a current pulse, the first (second) response signal comprises a voltage signal, and the unit of the first (second) response signal is Volt. In both cases, the first (second) maximum value of the first (second) load of the first (second) channel will be proportional to a maximum value of the first (second) response signal. For a given first maximum value of the first load of the first channel and for a given second maximum value of the second load of the second channel and for a given power capacity of the power supply 3 that produces the first and second supply signals, which power capacity is available for the first and second channels, a sum of a first product of the first maximum value of the first load of the first channel and the first maximum duty cycle and a second product of the second maximum value of the second load of the second channel and the second maximum duty cycle should be equal to or smaller than the power capacity.

As an example only, in case the load device 2 comprises a light-emitting-diode-strip that comprises five channels, the five duty cycles can be calculated as follows: $I_{max}=P_{max}/V_{output}=I_{ch1}DC_1+I_{ch2}DC_2+I_{ch3}DC_3+I_{ch4}DC_4+I_{ch5}DC_5$ whereby $P_{max}$ is the power capacity of the power supply 3, whereby $V_{output}$ is the output voltage signal of the power supply 3, whereby $I_{ch1}$ is the first maximum value of the first load of the first channel as for example shown in the FIG. 4, whereby $DC_1$ is the first maximum duty cycle, whereby $I_{ch2}$ is the second maximum value of the second load of the second channel as for example shown in the FIG. 4, whereby $DC_2$ is the second maximum duty cycle, whereby $I_{ch3}$ is the third maximum value of the third load of the third channel as for example shown in the FIG. 4, whereby $DC_3$ is the third maximum duty cycle, whereby $I_{ch4}$ is the fourth maximum value of the fourth load of the fourth channel as for example shown in the FIG. 4, whereby $DC_4$ is the fourth maximum duty cycle, whereby $I_{ch5}$ is the fifth maximum value of the fifth load of the fifth channel as for example shown in the FIG. 4, and whereby $DC_5$ is the fifth maximum duty cycle.

Owing to the fact that for a given color point the ratios between the duty cycles are known, it can be defined that: $DC_2=w\ DC_1$, $DC_3=x\ DC_1$, $DC_4=y\ DC_1$, and $DC_5=z\ DC_1$ whereby w, x, y and z are known. Owing to the fact that $P_{max}$ and $V_{output}$ and $I_{ch1}$ and $I_{ch2}$ and $I_{ch3}$ and $I_{ch4}$ and $I_{ch5}$ are known too, from the five equations, the five unknown maximum duty cycles $DC_1$-$DC_5$ can be calculated. For the purpose of dimming, these duty cycles may then for example be reduced.

Figure 9:
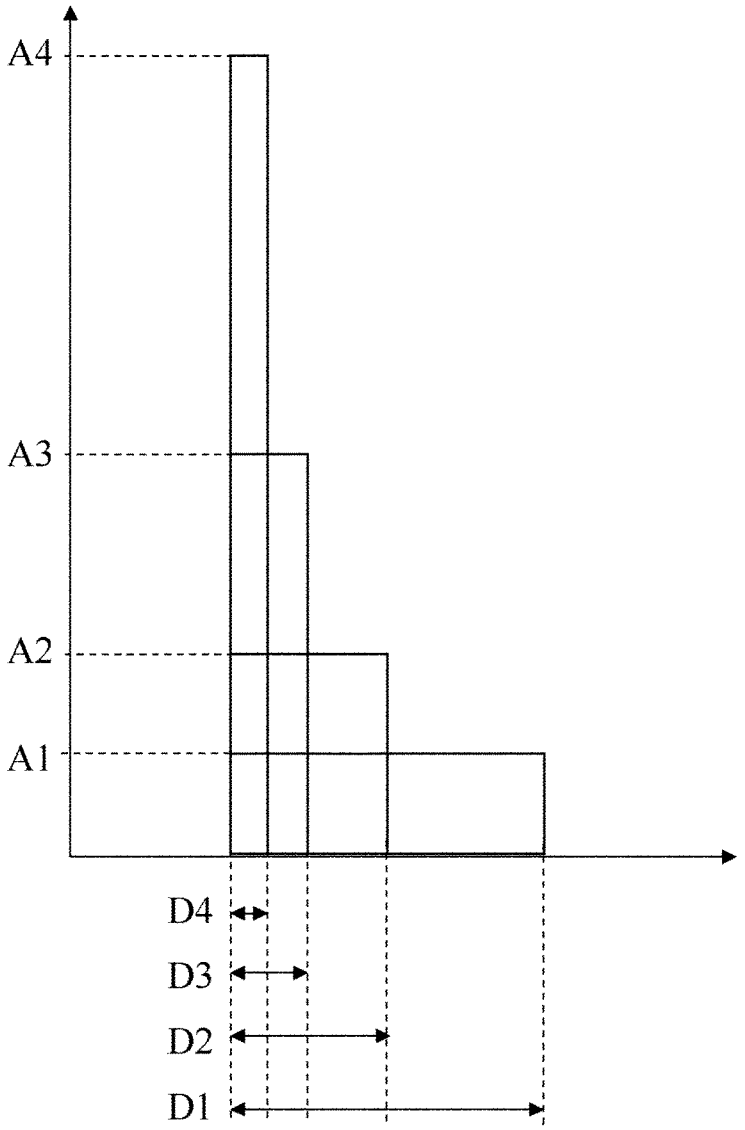
FIG. 9 shows duty cycles and amplitudes.

In the FIG. 9, duty cycles and amplitudes are shown (horizontal axis: duty cycle, vertical axis: amplitude). Clearly, the amount of power in a signal with an amplitude A1 at 100% duty cycle D1 corresponds with the amount of power in a signal with an amplitude A2=2 A1 at 50% duty cycle and with the amount of power in a signal with an amplitude A3=4 A1 at 25% duty cycle and with the amount of power in a signal with an amplitude A4=8 A1 at 12.5% duty cycle etc.

Figure 10:
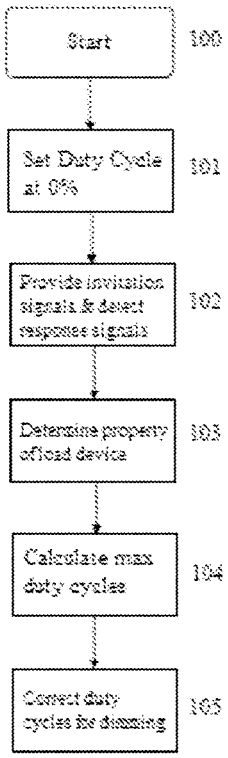
FIG. 10 shows a flow chart.

In the FIG. 10, a flow chart is shown, wherein the following blocks have the following meaning:

Block 100: Start.

Block 101: Set duty cycles at 0%.

Block 102: Switch to provide the invitation signals and detect the response signals.

Block 103: Determine the property of the load device.

Block 104: Calculate the maximum duty cycles for a given color point and property.

Block 105: Correct the duty cycles for dimming purposes.

An oversized power supply can provide all power required by many different load devices, but such an oversized power supply is expensive and inefficient. By having created the determination device, the oversized power supply can be easily avoided. Via adjustment of the duty cycles, a normal power supply can handle most kinds of different load devices, as well as load devices having varying properties, such as light-emitting-diode-strips, and this is another great technical advantage.

Instead of the simple detector, a more complex detector might be introduced that can detect several response signals simultaneously. Any detector might be integrated partly or entirely into the controller 17. Instead of using the switches 10-14 for switching the invitation signals as well as the supply signals, a first set of switches may be introduced for switching the invitation signals and a second set of switches may be introduced for switching the supply signals, in which case the switch 18 could be left out. First and second units can be coupled indirectly via a third unit, and can be coupled directly without the third unit being in between. So, the word "coupled" is not to be looked at too narrowly.

Summarizing, determination devices 1 determine properties of load devices 2 that may remain unchanged for said determining and that comprise first channels with first elements 20, 25. The determination devices comprise first switches 10 for providing first invitation signals to the first channels, detectors 15, 16 for detecting first response signals that result from the first invitation signals, and controllers 17 for deriving the properties of the load devices 2 from detections of the first response signals. The properties define first maximum values of first loads of the first channels, and the controllers 17 calculate first maximum duty cycles of first supply signals for supplying the first channels in view of the first maximum values of the first loads and power capacities of power supplies 3 that produce the first supply signals. The load devices 2 may further comprise second channels with second elements 21, 26, and the determination devices 1 may further comprise second switches 11.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A determination device for determining a maximum power dissipation property of a light emitting diode strip comprising a first channel with one or more first elements, the determination device comprising:

a first switch configured to provide a first voltage pulse to the first channel, a detector configured to detect a first current signal that results from a provision of the first voltage pulse to the first channel, and a controller configured to derive a maximum power dissipation property of the first channel of the light emitting diode strip from a detection of the first current signal, wherein the controller is further configured to calculate a first maximum duty cycle of a first power supply signal for supplying the first channel in view of both the maximum power dissipation property of the first channel and a power capacity of a power supply that produces the first power supply signal.

2. The determination device of claim 1, wherein the controller is further configured to control the first switch, and wherein the first switch is configured to switch the first current signal as well as the first power supply signal.

3. The determination device of claim 1, wherein the light emitting diode strip comprises multiple channels, each channel with one or more further elements, wherein the determination device further comprises:

a switch for each of the multiple channels, each switch configured to provide a voltage pulse to the channel associated with the switch, wherein the detector is configured to detect each of the current signals that result from a provision of the voltage pulse to each of the multiple channels, wherein the controller is configured to derive the maximum power dissipation property of the light emitting diode strip from a combination of the detection of each of the current signals, and wherein the controller is further configured to calculate a maximum duty cycle of a power supply signal for supplying each channel of the multiple channels in view of both of the maximum power dissipation property of the light emtting diode strip and the power capacity of the power supply that produces the power supply signals for powering each channel of the multiple channels.

4. The determination device of claim 3, wherein the controller is configured to control each of the switches, wherein each switch is configured to switch the voltage pulse as well as the power supply signal.

5. The determination device as of claim 3, wherein the switches are configured such that they, one after another, each provide a voltage pulse, and wherein the detector is configured to detect, one after another, each of the current signals that result from the provision of the voltage pulse.

6. A feeding device for feeding a light emitting diode strip, wherein the feeding device comprises both a power supply and the determination device as defined in claim 1.

7. A system comprising the feeding device as defined in claim 6, wherein the system further comprises the light emitting diode strip.

8. A method for determining a maximum power dissipation property of a light emitting diode strip comprising a first channel with one or more first elements, the method comprising the steps of:

providing, via a first switch, a first voltage pulse to the first channel, detecting, via a detector, a first current signal that results from a provision of the first voltage pulse to the first channel, deriving, via a controller, the maximum power dissipation property of the first channel of the light emitting diode strip from a detection of the first current signal, and calculating, via the controller, a first maximum duty cycle of a first power supply signal for supplying the first channel in view of the maximum power dissipation property of the first channel and a power capacity of a power supply that produces the first power supply signal.

9. The method of claim 8, wherein the light emitting diode strip comprises multiple channels, each channel with one or more further elements, the method further comprising the steps of:

providing, via a switch uniquely associated with a channel, for each of the multiple channels, a voltage pulse to the channel associated with the switch, detecting, via the detector, each of the current signals that results from a provision of the voltage pulse to each of the multiple channels, deriving, via the controller, the maximum power dissipation property of the light emitting diode strip from a combination of the detection of each of the current signals, calculating, via the controller, a maximum duty cycle of a power supply signal for supplying each of the multiple channels in view of both of the derived maximum power dissipation property of the light emitting diode strip and the power capacity of the power supply that produces the power supply signals for powering each of the multiple channels.

10. A computer program product for performing the steps of the method as defined in claim 8 when run via a computer.

11. A medium for storing and comprising the computer program product as defined in the claim 10.

12. The determination device of claim 1, wherein the controller derives the maximum power dissipation property of the first channel of the light emitting diode strip by comparing the first current signal with a reference value.

* * * * *